US006397024B1

(12) United States Patent
Rejewski et al.

(10) Patent No.: US 6,397,024 B1
(45) Date of Patent: May 28, 2002

(54) METHOD AND SYSTEM FOR REDUCING CONTAMINATION OF A CORONA CHARGER

(75) Inventors: Robert S. Rejewski, Brockport; Edward M. Eck, Lima, both of NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/665,397

(22) Filed: Sep. 20, 2000

(51) Int. Cl.[7] ..... G03G 15/02

(52) U.S. Cl. ..... 399/92; 399/93; 399/98; 399/100

(58) Field of Search ..... 399/92, 93, 98, 399/100, 170–172, 311; 73/147; 250/324–326

(56) References Cited

U.S. PATENT DOCUMENTS

| | | | | |
|---|---|---|---|---|
| 3,769,833 A | | 11/1973 | Ordway et al. | 73/147 |
| 3,869,909 A | | 3/1975 | Hale et al. | 73/147 |
| 5,128,720 A | * | 7/1992 | Creveling | 399/92 |
| 5,132,731 A | * | 7/1992 | Oda | 399/92 X |
| 5,424,540 A | | 6/1995 | Garcia et al. | 250/326 |
| 5,612,768 A | * | 3/1997 | Kim et al. | 399/92 |
| 5,802,424 A | * | 9/1998 | Pernesky et al. | 399/92 |
| 6,038,120 A | | 3/2000 | May et al. | 361/229 |
| 6,070,026 A | * | 5/2000 | Claflin, Jr. et al. | 399/92 |

* cited by examiner

*Primary Examiner*—William J. Royer

(57) ABSTRACT

A method for reducing contamination of a corona charger in an electrophotographic process wherein the corona charger imparts a charge to a photoconductor film passed by the corona charger, by identifying contaminated air flow streams and determining the direction of flow of the contaminated air flow stream flowing past or into the corona charger and positioning at least one plate to divert the contaminated air flow streams away from the corona charger.

20 Claims, 4 Drawing Sheets

METHOD AND SYSTEM FOR REDUCING CONTAMINATION OF A CORONA CHARGER

FIELD OF THE INVENTION

This invention relates to a method for reducing contamination of a corona charger in an electrophotographic process by identifying and directing contaminated airflow streams away from the corona charger.

BACKGROUND OF THE INVENTION

In many electrophotographic processes for the production of copies, corona charges are used to impart a charge to a photoconductive film which is subsequently passed to an imaging section, a developing section and an image transfer section where the image on the photoconductor film is transferred to a paper to produce a copy of the image on the paper. The paper is subsequently passed to a fuser section where a toner image on the paper is fixed to the paper by elevated temperature and pressure in the fuser section. The photoconductor film then passes through a neutralization section and thereafter past a brush cleaner which removes contaminants from the film prior to passing the photoconductor film back to the primary charging section.

Many of the operations conducted in the photocopying process generate contaminated air streams which may be directed to and passed by or into the corona charger. Such streams are typically produced in copier machine systems such as the environmental control system, the cleaning blower system, the writer blower system, paper transport fan systems, cooler fan systems, the charger rest blower system and the like. All of these systems produce air streams which may contain contaminants of one sort or another. Particularly, streams which may contain fuser oil or toner represent significant contaminants to the corona charger.

As well known to those skilled in the art, as shown for instance in U.S. Pat. No. 5,424,540, "Corona Charger Wire Tensioning Mechanism" issued Jun. 13, 1995 to Garcia, et al and U.S. Pat. No. 6,038,120, "AC Corona Charger With Buried Floor Electrode" issued Mar. 14, 2000 to May, et al., it is disclosed that corona chargers typically include bare corona wires which are located between a grid electrode and a shield. These patents are hereby incorporated by reference. These wires are relatively small in diameter and since they are highly charged, contamination of these wires by materials such as fuser oil, toner dust particles and the like can create charger arcing which causes machine errors and non-uniform charging which creates copy image problems.

One approach to the control of such contamination is the control of the flow of such contamination from the sources of the contamination. This requires very close control of the environment around substantially every operating system in the copy machine and is not considered feasible.

Nevertheless, it is necessary that the corona charger be replaced relatively frequently or that a system be developed to minimize contamination of the corona charger by airborne contaminants in the copy machine.

Accordingly, a continuing search has been directed to the development of methods to minimize such contamination.

SUMMARY OF THE INVENTION

According to the present invention, contamination of a corona charger is reduced in an electrophotographic process wherein the corona charger imparts a charge to a photoconductor film passed by the corona charger by: identifying contaminated air flow streams and determining the direction of flow of the contaminated air flow stream flowing past or into the corona charger and positioning at least one plate to divert the contaminated air flow streams away from the corona charger.

The invention further comprises a contamination protected corona charger system comprising: a corona charger; at least one plate positioned to direct contaminated air flows away from the corona charger and at least partially enclose a controlled air circulation space around the corona charger and a clean gas supply positioned to discharge a clean gas between the at least one plate and a photoconductor film passed by the corona charger to provide a positive clean gas pressure between the at least one plate and the photoconductor film in the controlled air circulation space.

The invention also comprises an improvement in a method for producing photocopies wherein a corona charger is used to charge a photoconductor film passed by the corona charger, the improvement comprising identifying and determining the flow direction of contaminated air flow streams and positioning at least one plate to divert the contaminated air flow streams away from the corona charger.

DESCRIPTION OF THE PREFERRED EMBODIMENTS

Figure 1:
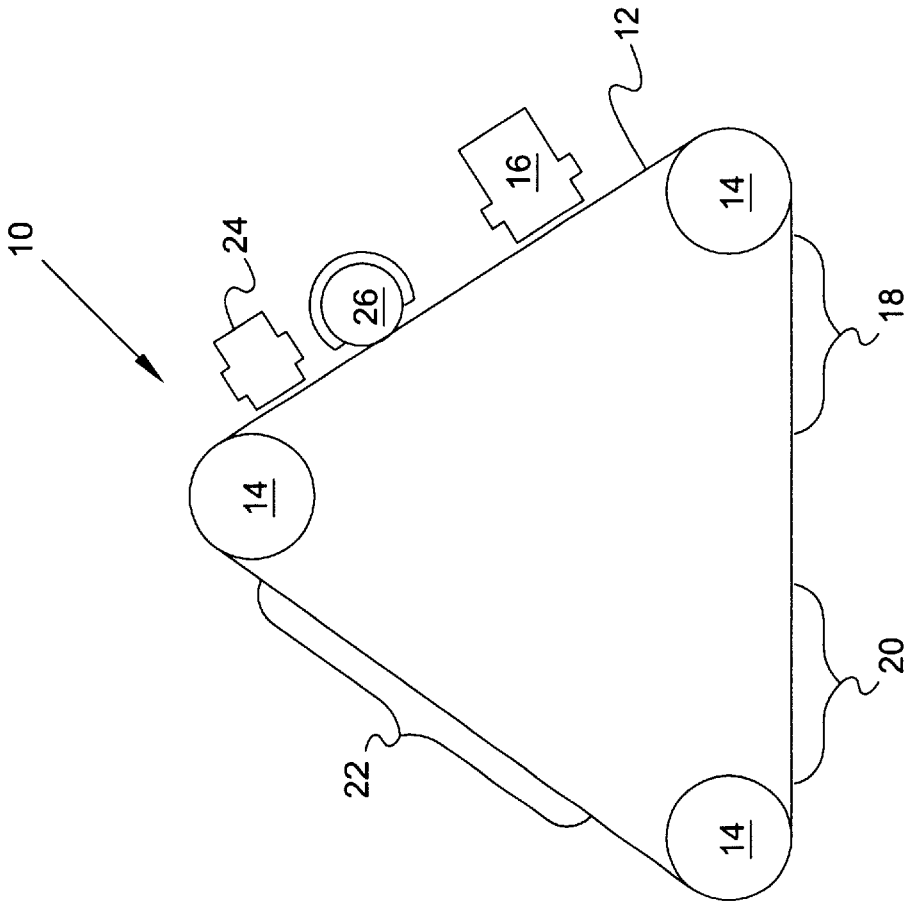
FIG. 1 (PRIOR ART)
FIG. 1 is a schematic diagram of a representative prior art electrophotographic process utilizing a photoconductor film in a continuous loop.

In the discussion of the Figures, the same numbers will be used throughout to refer to the same or similar components. In FIG. 1, a schematic diagram 10 of the flow path of a photoconductor film in an electrophotographic process is shown. A photoconductor film 12 is shown schematically supported by three rollers 14. The photoconductor film is typically charged in a primary charging section by a corona charger 16. The charged film then passes to an imaging section 18 where an image it is transmitted electrophotographically or digitally or the like as known to those skilled in the art to the film. The film then passes through a developing section 20 where a toner which comprises a polymeric material which is adapted to become fixed to paper to produce a copy is positioned on the desired image. The image may be either a positive or a negative image as desired. The film is then passed to an image transfer section 22 where a toner forming the image is transferred to a paper which is typically charged to receive the toner from the photoconductor film. The paper is subsequently passed through a fuser section (not shown) where the toner is caused to become fixed to the paper by heat and pressure to produce the finished copy. The photoconductor film is then passed to a neutralization section shown as a corona charger 24 where it is neutralized. The photoconductor film is then contacted by a brush cleaner 26 which typically rotates in a direction such that the brush surface contacts the film in a direction opposite to the direction of movement of the film past the brush. Contaminants removed by the brush are at least partially removed from the brush by any suitable means. The photoconductor film then passes back to the primary charging section and the process is repeated. Such processes are well known to those skilled in the art and while they involve considerably more complexity than detailed above, it is considered that such processes are well known and need not be discussed further.

The corona charges are an important feature of the copying process. Typically such processes may incorporate at least two corona chargers. One is a preclean charger and one is a primary charger. A similar charger may be used with the paper prior to transferring the color image to the paper.

The corona charging devices comprise at least one corona wire in a housing. The corona wires are basically bare conductor wires which are located between a grid electrode and a shield and typically carry a relatively high voltage. These wires are relatively small and since they are highly charged they tend to attract contaminants. When they become contaminated, the contamination can result in charger arcing which causes machine errors and malfunctions and non-uniform charging which causes copy quality defects. In copy machines, contaminated air streams can be generated from normal machine operations by environmental control systems, cleaning blowers, writer blowers, paper transport fans, cooler fans, charger rests, blowers and the like. Major contaminants which have been found to be detrimental to corona charger operations are fuser oil residues from the fusing operation arid toner. Other contaminants are also detrimental to corona charger operation and many of these contaminants are airborne. It is difficult if not impossible to control the emission of air streams carrying airborne contaminants from copying/duplicating machine systems. Similarly it is difficult to completely enclose the corona chargers.

Figure 2:
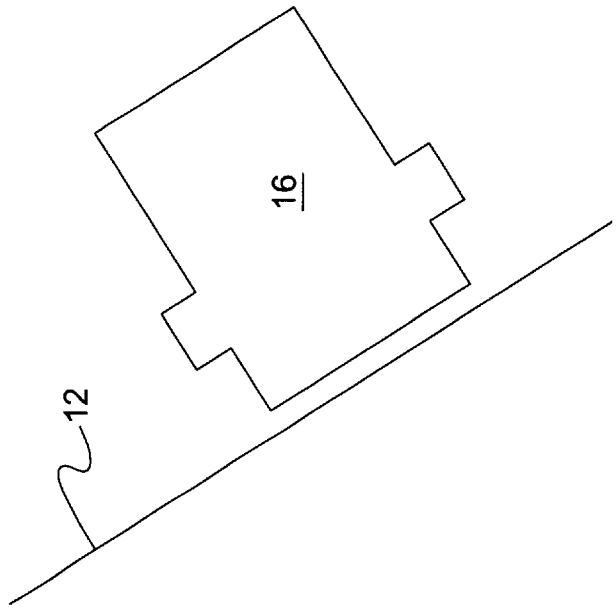
FIG. 2 (PRIOR ART)
FIG. 2 is a schematic diagram of a corona charger positioned next to a photoconductor film.

In FIG. 2, a typical position of a corona charger 16 adjacent a photoconductor film 12 is shown. The film typically passes by the charger and is charged as it passes to the image forming section.

Figure 3:
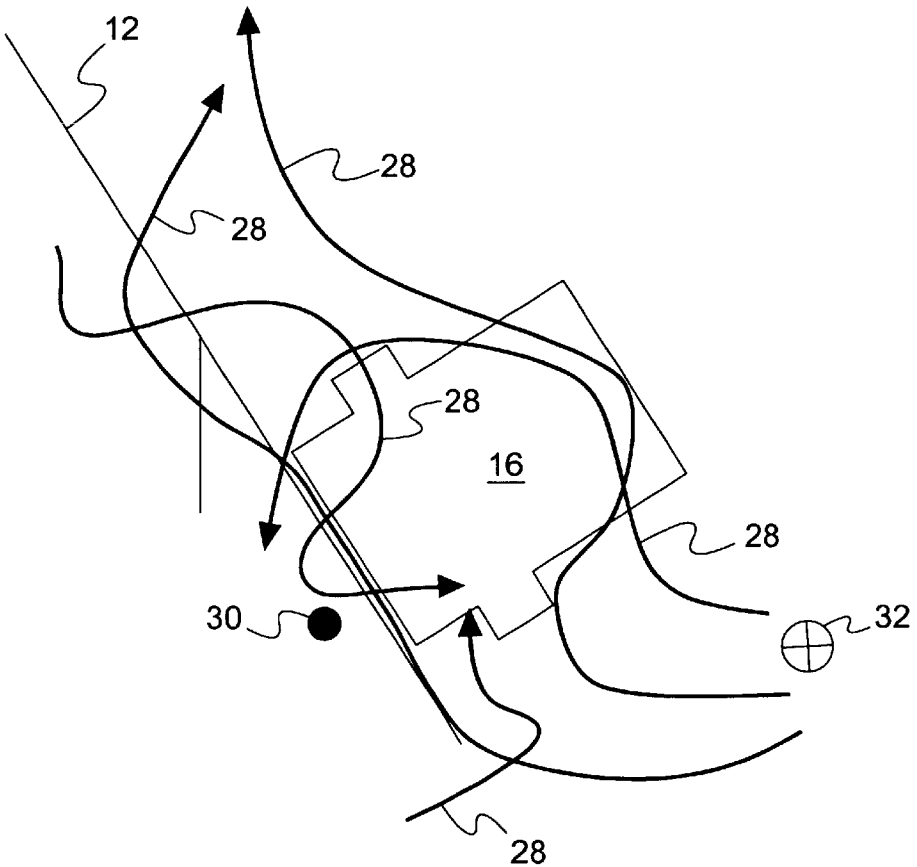
FIG. 3 (PRIOR ART)
FIG. 3 is a schematic diagram of the corona charger of FIG. 2 showing contaminated airflows in the vicinity of and passing into the corona charger.

In FIG. 3, the results of a determination of air currents in the vicinity of and entering into the corona discharger in a copier/duplicatior machine is shown. The contaminated airflows are shown by lines 28. Contaminated airflows are also shown by a dot 30 which represents an airflow directed out of the page and by a cross in a circle 32 which represents an airflow stream which is passing into the page. This view is taken from the front of a copier/duplicator machine in the vicinity of the corona charger. Many machine elements have been eliminated from the Figure for simplicity.

Figure 4:
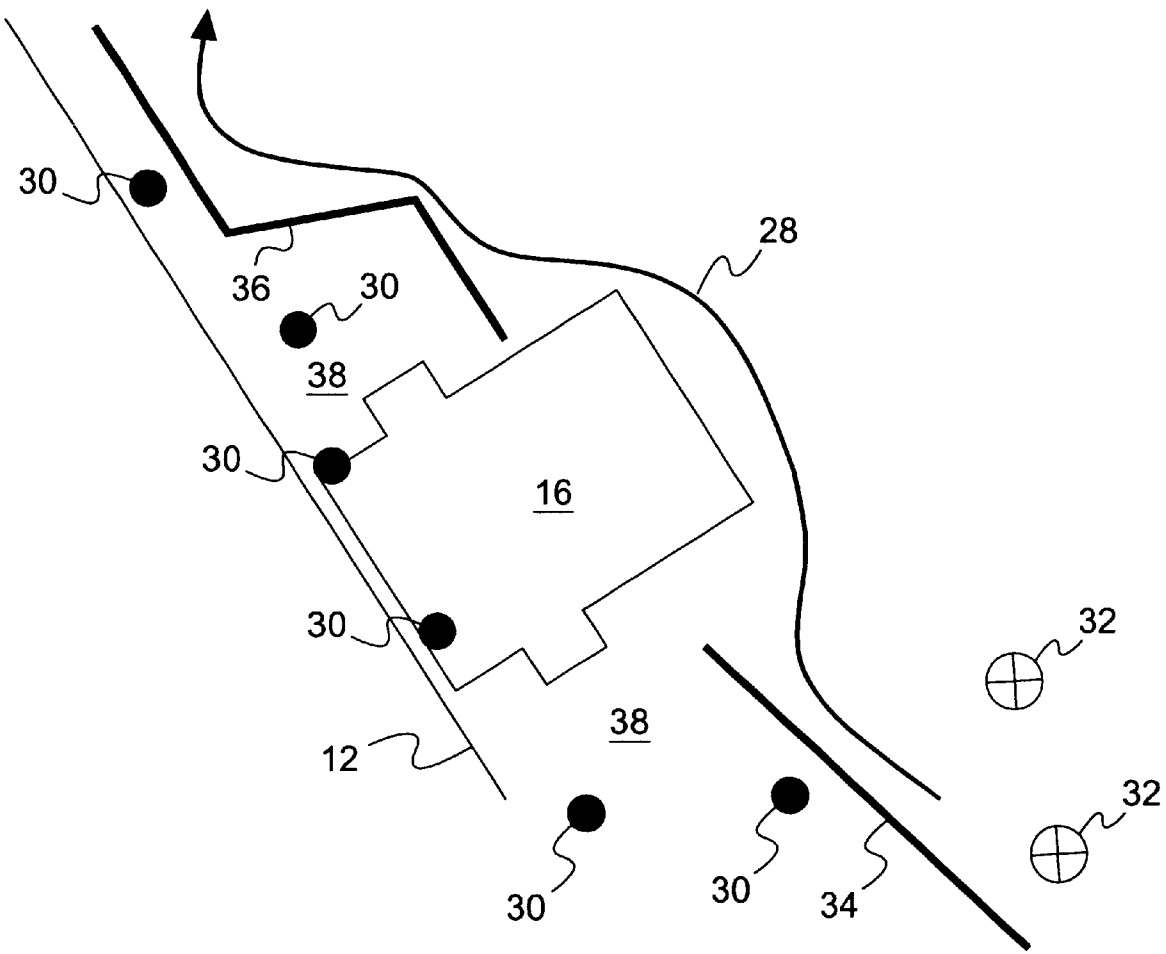
FIG. 4 is a schematic diagram of the corona charger of FIG. 2 with plates positioned to deflect contaminated airflows away from the corona charger; and, FIG. 5 is a sketch of a corona charger with the deflector plates in position.

In FIG. 4, the corona charger of FIG. 3 is shown with shields 34 and 36 in position to deflect air streams away from corona charger 16. The injection of cleaned gas is shown by dots 30 representing the flow of clean gas outwardly from the vicinity of corona charger 16. Gas flow into the page is shown by crossed circles 32. A controlled air circulation space 38 is formed by photoconductor film 12 and plates 34 and 36. Desirably plates 34 and 36 are placed to closely join corona charger 16. The injection of cleaned gas, which is typically cleaned air obtained by filtering air from a suitable source and the like, is passed into this controlled air circulation space at a rate sufficient to maintain a slight but positive pressure in the controlled gas circulation space. This positive pressure in combination with the plates and the photoconductor film results in preventing the entry of contaminated airflow streams into the controlled gas circulation space thereby preventing contamination of the corona charger by airborne contaminants.

Figure 5:
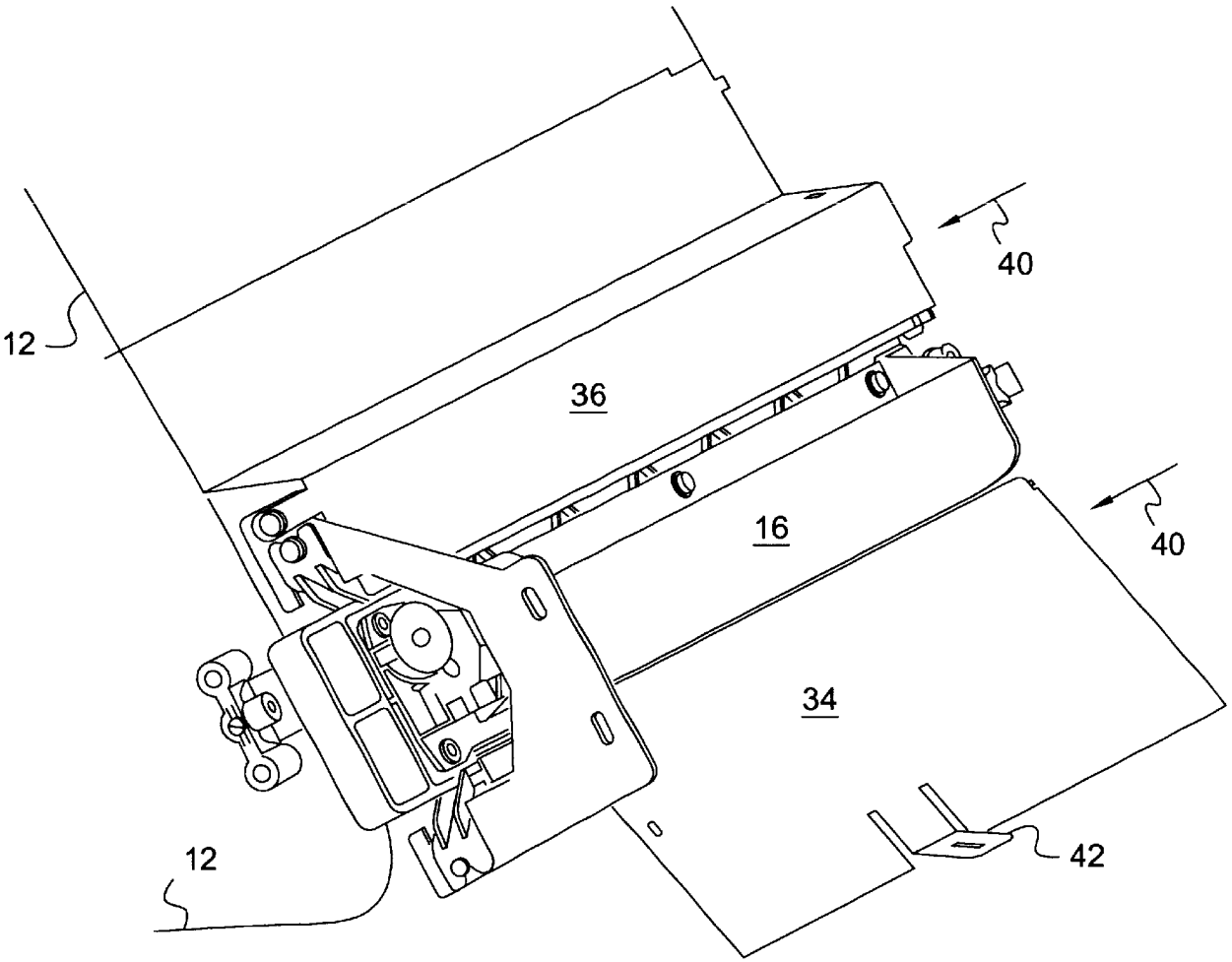

In FIG. 5, a drawing of an embodiment of the present invention is shown. The corona charger is shown positioned next to the photoconductor film so that plates 34 and 36 along with corona charger 16 define the controlled gas circulation space 38. As indicated, plate 34 may have a fastener 42 which enables it to be fastened to a bottom of the copier/duplicator machine or the like.

The plates can be of a variety of configurations as required for the deflection of the contaminated air streams away from corona charger 16.

A major difficulty in designing deflector plates 34 and 36 is the determination of the position and direction of contaminated airflows in the vicinity of the corona charger. This is readily accomplished by the use of smoke, fog produced by the interaction of water and dry ice or preferably by the use of neutrally buoyant helium-filled bubbles. Such helium-filled bubbles basically comprise an aqueous soap solution film filled with helium. The net density of the bubble is substantially the same as that of air so that the bubbles remain suspended indefinitely if left alone in the absence of any airflow. Such bubbles are readily observed either as they remain in the air or as they flow with the air by the use of any suitable high intensity light.

The bubbles are typically from about 50 to about 100 microns in diameter, although other sizes may be used if desired.

The production and use of such bubbles for the termination of airflow has been described in U.S. Pat. No. 3,769.833, issued Nov. 6, 1973 to Ordway, et al and U.S. Pat. No. 3,869,909 issued Mar. 11, 1975 to Hale, et al. These U.S. patents are hereby incorporated in their entirety by reference. The bubbles are desirably generated and then released in the vicinity of the corona charger and the movement of the bubbles observed to determine the location and flow direction of contaminated air streams in the vicinity of the corona charger. Once the location and flow direction of the contaminated air streams has been completed, then plates can be designed to deflect the contaminated air streams away from the corona charger. The plates are then positioned to deflect the contaminated airflow streams and the plates alone are a substantial improvement in the reduction of contamination of the corona charger.

Further improvement is achieved by injecting a cleaned gas stream which may be filtered air or any other suitable gas into the space defined by the photoconductor film, the plates and the corona charger. The presence of a positive pressure of clean air in this space prevents the entry of contaminated airflows into this space. The pressure may be small, i.e., as small as one inch of water or less, but should be a definite positive pressure so that contaminated airflows do not enter areas of the corona charger.

This protection may be used for the primary corona charger for the preclean corona charger or for any other corona charger used in the copier/duplicator machine. The air is injected by any suitable means, such as by open lines passing the air into or directed toward the controlled air circulation space or the like. Such air injection is shown schematically in FIG. 5 by lines 40.

While reference has been made to a plurality of plates, a single plate could be used if it can be formed to function effectively. It is believed that in general because of the presence of other components of the copier/duplicator machine and the like that it would be advantageous to form the deflector plate as a plurality of plates which are separately positioned to achieve the desired air deflection.

In tests performed using the method of the present invention, it was found that both the preclean and the primarily chargers used in the machine used for the test experienced greatly reduced contamination as a result by the installation of the plates. Even further reductions are anticipated when the injection of the filtered, cleaned gas is used.

Having thus described the invention by reference to certain of its preferred embodiment, it is respectfully pointed out that the embodiments described are illustrative rather than limiting in nature and that many variations and modifications are possible within the scope of the present invention.

Having thus described the invention, we claim:

1. A method for reducing contamination of a corona charger in an electrophotographic process wherein: the corona charger imparts a charge to a photoconductor film passed by the corona charger, the method comprising:

a) identifying contaminated air flow streams and determining the direction of flow of the contaminated air flow streams flowing past or into the corona charger; and;

b) positioning at least one plate to divert the contaminated air flow streams away from the corona charger.

2. The method of claim 1 wherein the contaminated air flow streams are identified and their direction of flow is determined by discharging neutrally buoyant bubbles in the vicinity of the corona charger and observing the movement of the bubbles.

3. The method of claim 1 wherein the corona charger is a primary charger in the electrophotographic process.

4. The method of claim 1 wherein at least two plates are used.

5. The method of claim 1 wherein the corona charger is a preclean corona charger.

6. The method of claim 1 wherein a cleaned gas is injected between the photoconductor film and at least one of the corona charger and the at least one plate.

7. The method of claim 6 wherein the cleaned gas is injected in a quantity sufficient to maintain a positive pressure between the photoconductor film and the at least one plate.

8. A contamination protected corona charger system comprising:

a) a corona charger;

b) at least one plate positioned to direct contaminated air flows away from the corona charger and at least partially enclose a controlled air circulation space around the corona charger; and c) a clean gas supply positioned to discharge a clean gas between the at least one plate and at photoconductor film passed by the corona charger to provide a positive clean gas pressure between the at least one plate and the photoconductor film in the controlled air circulation space.

9. The system of claim 8 wherein a plurality of plates are included.

10. The system of claim 8 wherein the controlled air circulation space is formed by the photoconductor film, the at least one plate and the corona charger.

11. The system of claim 8 wherein the corona charger is a primary charger.

12. The system of claim 8 wherein the corona charger is a preclean charger.

13. The system of claim 8 wherein the clean gas supply is a supply of cleaned air.

14. In a method for producing photocopies wherein a corona charger is used to charge a photoconductor film passed by the corona charger, the improvement comprising identifying and determining the flow direction of contaminated air flow streams and positioning at least one plate to divert the contaminated air flow streams away from the corona charger.

15. The improvement of claim 14 wherein a plurality of plates are used.

16. The improvement of claim 14 wherein the contaminated air streams are identified and their flow direction determined by discharging neutrally buoyant bubbles in the vicinity of the corona charger and observing the movement of the bubbles.

17. The improvement of claim 16 wherein the bubbles comprise an aqueous glycerine soap solution film filled with helium.

18. The improvement of claim 16 wherein the bubbles are observed for air flow visualization with a high intensity light source.

19. The improvement of claim 16 wherein the bubbles are from about 50 to about 100 microns in diameter.

20. The improvement of claim 14 wherein a flow of clean gas is injected between the photoconductor film and the at least one plate.

* * * * *